US006138293A

United States Patent [19]

Mathews

[11] Patent Number: 6,138,293

[45] Date of Patent: Oct. 31, 2000

[54] ADJUSTABLE MOUNTING COLLAR FOR A RETRACTABLE CLEANING HEAD

[75] Inventor: Lester Mathews, Phoenix, Ariz.

[73] Assignee: Caretaker Systems, Inc., Scottsdale, Ariz.

[21] Appl. No.: 09/332,679

[22] Filed: Jun. 14, 1999

[51] Int. Cl.[7] ..... E04H 4/00

[52] U.S. Cl. ..... 4/492; 4/496; 4/541.6; 239/204

[58] Field of Search ..... 4/492, 496, 506, 4/507, 541.6, 490; 239/204, 205, 206

[56] References Cited

U.S. PATENT DOCUMENTS

| | | | |
|---|---|---|---|
| 3,578,023 | 5/1971 | Dieraind | 4/492 |
| 4,438,537 | 3/1984 | Bickle | 4/492 |
| 4,939,797 | 7/1990 | Goetti | 4/492 |
| 5,172,432 | 12/1992 | Beland | 4/492 |

*Primary Examiner*—David J. Walczak
*Attorney, Agent, or Firm*—LaValle D. Ptak

[57] ABSTRACT

A fitting, in the form of a mounting collar for installation of a water input nozzle, such as a cleaning head in the floor and walls of a swimming pool, is designed to permit the fitting to be rocked from side to side a limited amount relative to the central axis of a water supply pipe in which the fitting is inserted during initial installation. This is done to allow for installation discrepancies where the water supply pipe is not perpendicular to the surface of the pool where the pipe opens into the pool. By allowing this amount of movement in the installation of the mounting collar, the orientation of a pop-up cleaning head, for example, with respect to the pool floor or wall, is ensured to be perpendicular; so that optimum cleaning of the pool surface during subsequent use of the system occurs.

19 Claims, 3 Drawing Sheets

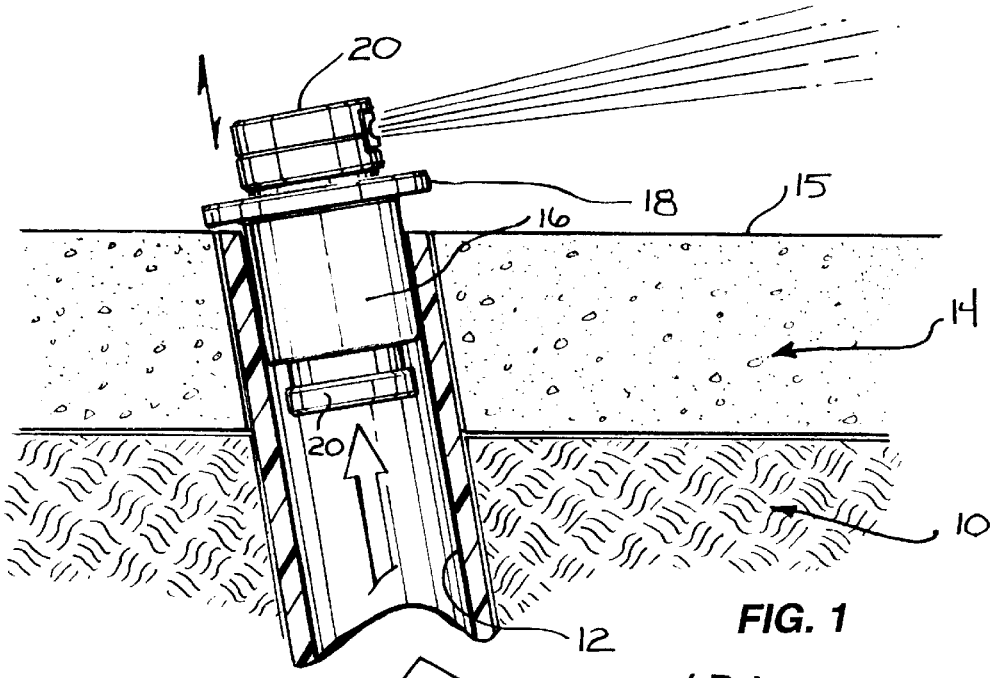
FIG. 1
( Prior Art )
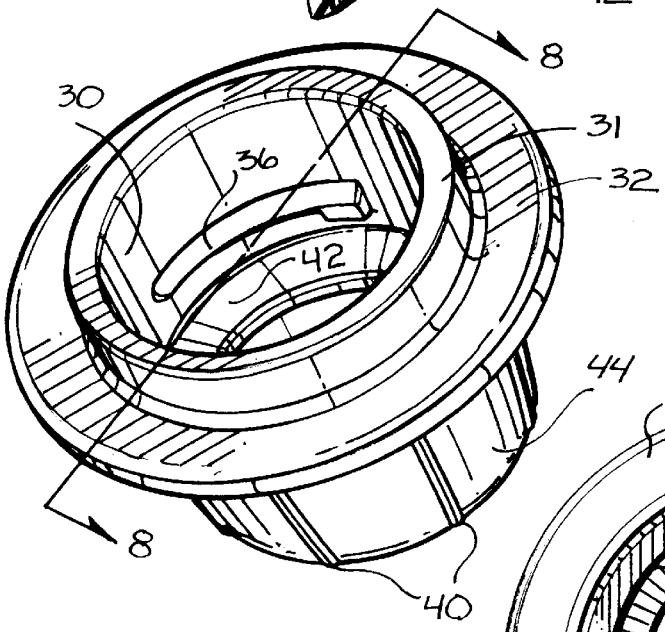
FIG. 2
FIG. 3
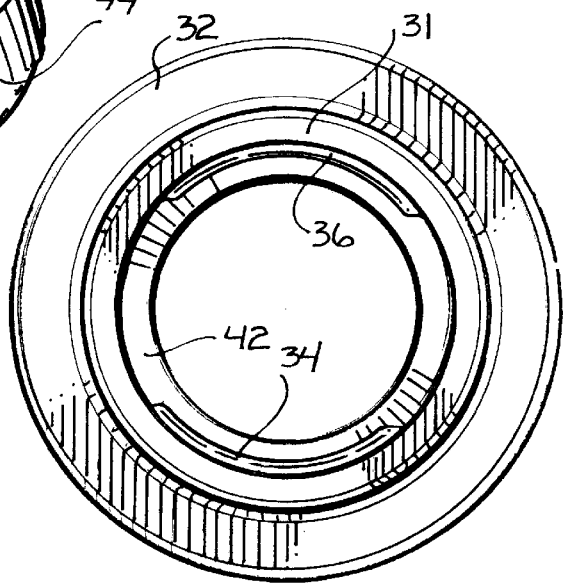

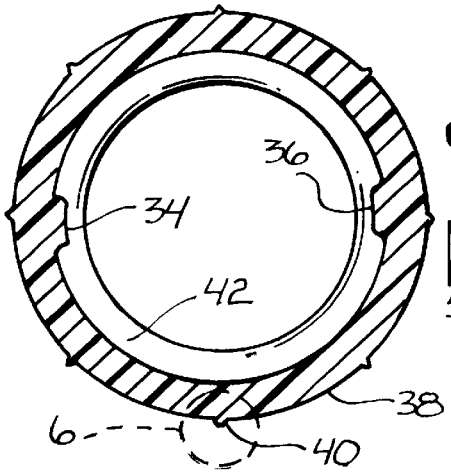
FIG. 5
FIG. 4
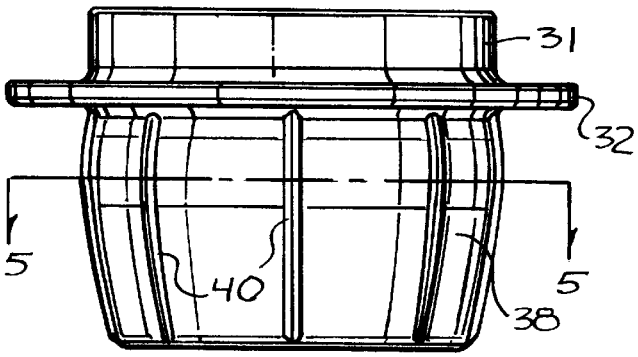
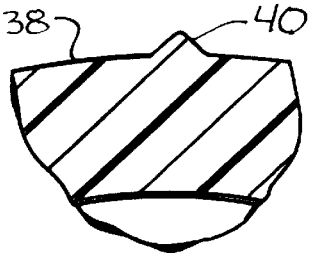
FIG. 6
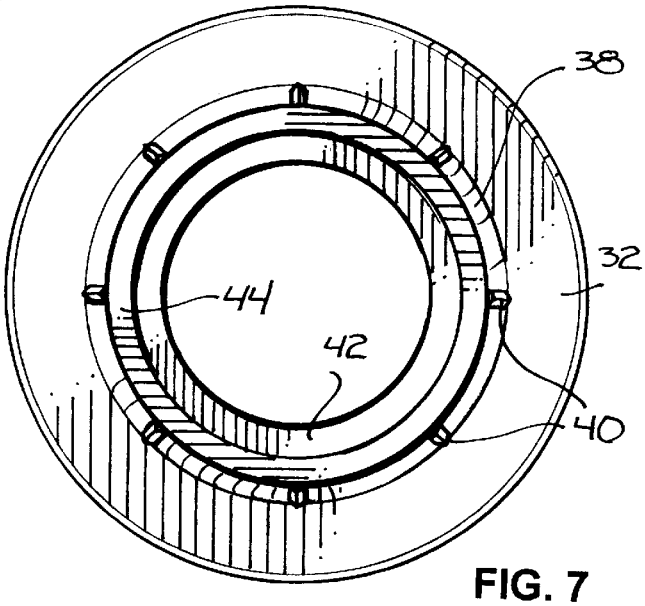
FIG. 7
FIG. 8
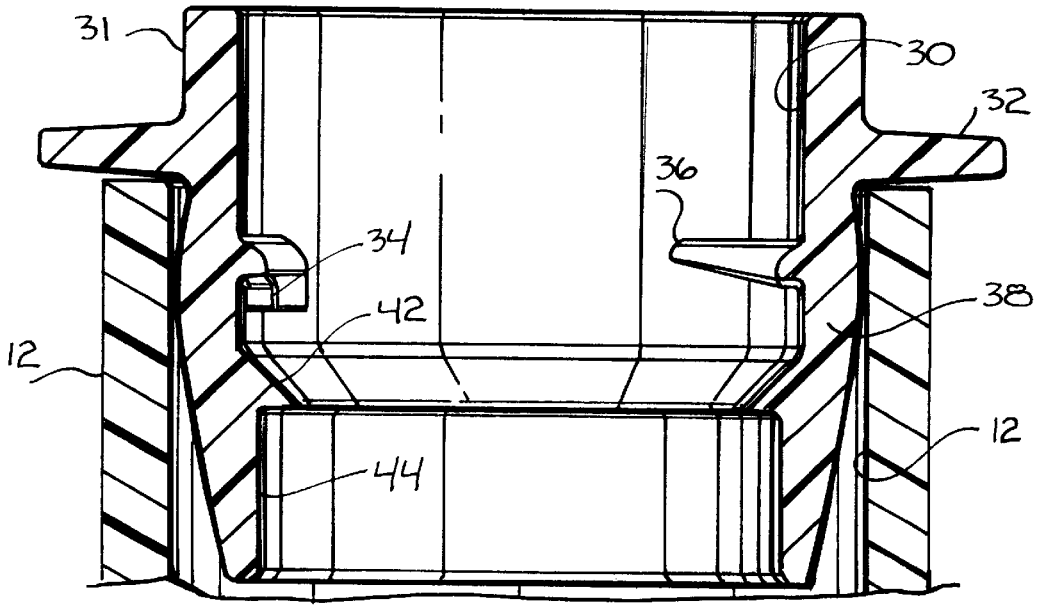

ADJUSTABLE MOUNTING COLLAR FOR A RETRACTABLE CLEANING HEAD

BACKGROUND

In-floor cleaning systems now are common in the swimming pool industry. These systems typically consist of pop-up or retractable cleaning heads in the floor of the swimming pool. During times when no cleaning of the pool takes place, the heads are retracted into a retaining collar, and are substantially flush with the bottom of the pool. The heads are connected to a water supply piping system fed from the pool pump. When cleaning is desired, pressurized water from the pump causes the cleaning heads to extend or pop up from the flush position on the pool floor and to eject a stream of water across and substantially parallel with the pool bottom.

Swimming pool bottoms are not always level. Tradesmen apply the concrete with concrete pumping machines; and the tradesmen try to make the bottoms as level as possible; but this is next to impossible. The end result of most swimming pool construction is that the bottoms are not flat and level. In addition, most swimming pools are constructed with rounded radii corners to add strength to the structure and to avoid 90° angles at the transition between the floor and the wall of the pool. This transition point normally is a two foot to five foot radius. When cleaning heads are installed in the pool, it is extremely important that the cleaning nozzles eject water evenly across the floor of the pool and parallel with the floor.

During construction, the piping system is installed after excavation and prior to the placement of the concrete. The pipes for the cleaning heads are stubbed up from the buried supply pipes of the system to accommodate the future cleaning heads. The angle of the stubbed up pipe must be perpendicular to the final shell construction angle of the pool bottom and sides. It is nearly impossible for a plumbing installer to determine the exact finish angle at this stage of construction. The installer can only use his best judgement as to where or what angle the concrete floor will be. The plumbing installer tries to set the stub-up to the projected angle. Most of the time, however, the angle of the stub-up pipe, into which the retractable cleaning head is to be installed, is not perpendicular to the floor. This causes the jet of water from the pop-up cleaning head to project above the floor on one side of the head revolution, and to shoot downward into the floor close to the pipe on the other side of the revolution. Both of these situations cause the cleaning head to miss spots of dirt on the floor and/or wall surfaces.

In extreme cases, when the angles of the stub-up pipes deviate considerably from being perpendicular with the bottom of the pool shell, they must be jackhammered out, and the pipe heated to change the stub-up angle to be perpendicular to the floor. This is a costly and time consuming repair. In addition, this type of repair affects the strength of the pool when the floor is patched around the jackhammered out and readjusted pipe. On the other hand, if the angle is not corrected, the system does not clean as represented to the pool buyer.

It is desirable to provide a new, adjustable fitting or mounting collar that houses the pop-up cleaning head, and which compensates for incorrect stub-up angles of the supply pipe to allow the finally installed retractable cleaning head to be exactly perpendicular to the floor around the stubbed-up pipe.

SUMMARY OF THE INVENTION

It is an object of this invention to provide an improved mounting collar for retractable pop-up cleaning heads in a swimming pool.

It is another object of this invention to provide an improved mounting collar and retractable cleaning head retainer for a swimming pool which allows the cleaning head to be installed exactly perpendicular to the wall or floor of the pool.

It is an additional object of the invention to provide an improved mounting collar for the installation of a retractable cleaning head in a swimming pool which, upon installation, allows corrections of installation angles between the stub-up pipe and the wall or floor of the pool to ensure that the cleaning head is mounted perpendicularly to the wall or floor of the pool.

It is a further object of this invention to provide an adjustable mounting collar for correcting the angle of installation of pop-up cleaning heads in swimming pools.

In accordance with a preferred embodiment of the invention, a mounting collar for the installation of a retractable cleaning head in a swimming pool includes a main body portion. This main body portion is designed to fit into the end of a water supply pipe in a pool, where the supply pipe has been cut off even with the surface of the pool. A flange extends outwardly from the periphery of the main body portion of the mounting collar to overlie the end of the water supply pipe. An outside wall on the main body portion of the mounting collar is curved to permit a predetermined amount of transverse tipping of the main body portion in the water supply pipe at the time of installation to ensure that the mounting collar (and, therefore, the retractable cleaning head) is oriented perpendicularly to the pool floor, thereby compensating for angular misalignments between the water supply pipe and the surface of the pool floor.

BRIEF DESCRIPTION OF THE DRAWINGS

FIG. 1 is a partially cut-away representation of a prior art pop-up or retractable cleaning head installation collar illustrating problems encountered during the installation and use of prior art collars;

FIG. 2 is a top perspective view of a preferred embodiment of the invention;

FIG. 3 is a top view of the embodiment shown in FIG. 2;

FIG. 4 is a side view of the embodiment shown in FIG. 3;

FIG. 5 is a cross-sectional view taken along the line 5—5 of FIG. 4;

FIG. 6 is an enlarged detail of the portion encircled in FIG. 5;

FIG. 7 is a bottom view of the embodiment shown in FIG. 2;

FIG. 8 is a cross-sectional view of the embodiment shown in FIGS. 2 through 7 illustrating the manner of installation in a properly oriented water supply pipe.

DETAILED DESCRIPTION

Figure 9:
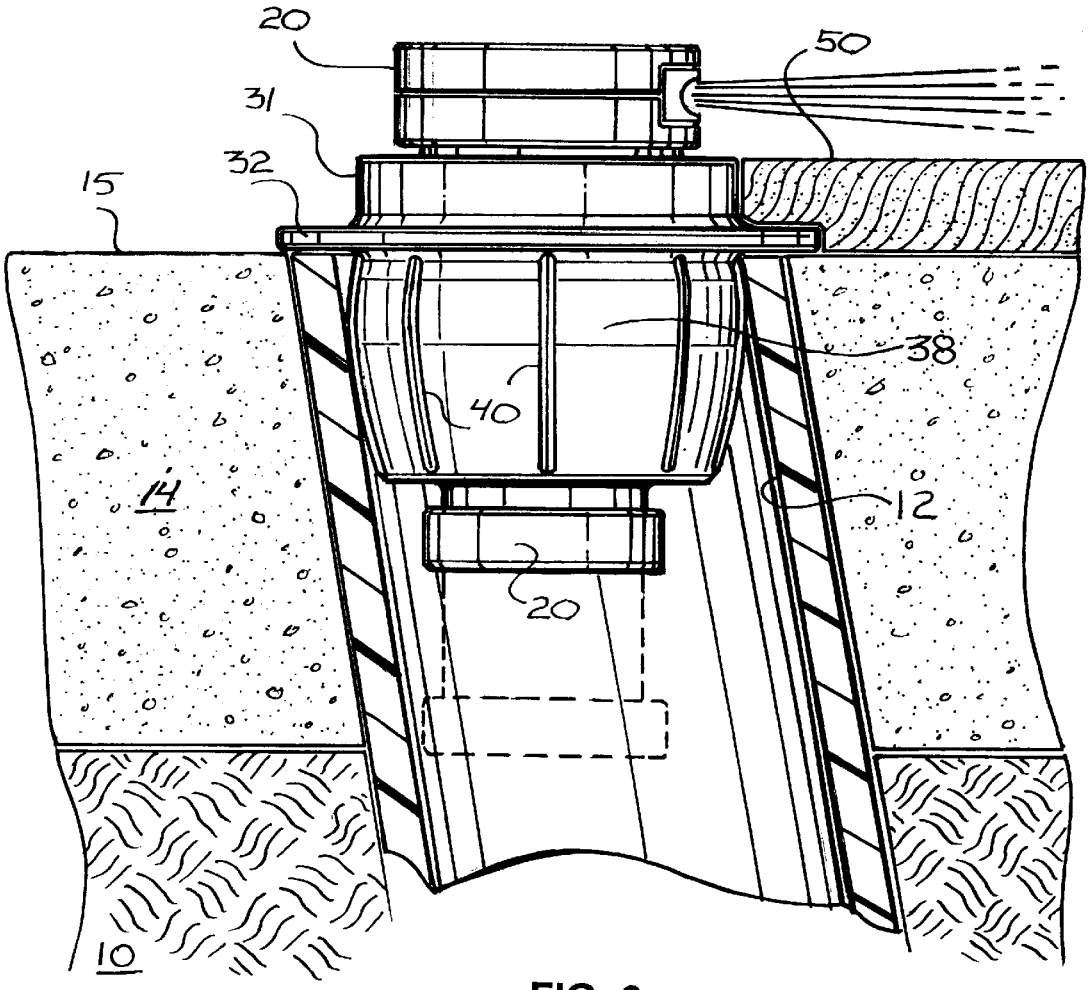
FIG. 9 is a partial cross-sectional view similar to that of FIG. 1 illustrating the manner in which the embodiment shown in FIGS. 2 through 8 effects the desired correction of the problem shown in the prior art device of FIG. 1.

Reference now should be made to the drawings, in which the same reference numbers are used throughout the different figures to designate the same or similar components. FIG. 1 is a partially cut-away cross-sectional view of a prior art installation of a mounting collar for a retractable or pop-up cleaning head for a swimming pool showing the problems which are inherent in such a prior art mounting collar.

As shown in FIG. 1, a PVC water supply pipe supply 12 is stubbed out through the soil 10 in the bottom of a pool excavation, and opens at the surface 15 of the concrete floor 14 poured in the pool. Ideally, the stubbed-out pipe 12 should have its central axis perpendicular to the plane of the surface 15 of the concrete floor 14. As illustrated in FIG. 1, however, and as described previously in the background portion of this specification, it is difficult to cause the water supply pipe 12 to be perfectly perpendicular to the surface 15 of the concrete 14. FIG. 1 exaggerates the problem. After the pipe 12 has been stubbed out and the concrete 15 has been poured, the pipe 12 is cut off flush with the surface 15 of the concrete 14. Then, it has been the practice in the past to insert and secure a cylindrical cleaning head retainer or mounting collar 16 into the interior of the pipe 12 and to cement the collar in place with an outwardly projecting flange 18 abutting the end of the pipe 12.

When the pipe 12, however, is not perpendicular to the pool surface 15, the situation shown in FIG. 1 exists. As illustrated, the flange 18 contacts the pipe 12 on the left-hand side of FIG. 1 and is spaced above the pool floor surface 15 and the end of the pipe on the right-hand side, as shown in FIG. 1. The result of the mounting, which occurs relatively frequently in prior art installations, and which is shown in exaggerated form in FIG. 1, is to cause a pop-up or retractable cleaning head 20, which reciprocates in the collar 16, to have its central axis at an angle other than 90° to the surface 15 of the concrete 14 of the pool floor. This results in the situation illustrated diagrammatically in FIG. 1. At the extreme position shown for the right-hand side of FIG. 1, the cleaning head projects water flow outwardly in the direction of the lines shown at an angle to the pool floor, and not across the surface 15 of the pool floor. When the head 20 is rotated in a conventional manner to a position 180° from the one shown in FIG. 1 for a subsequent cleaning cycle, the water projected strikes the surface 15 of the pool floor very close to the collar 18; and inefficient cleaning results. In both cases, uncleaned surfaces or areas exist on the pool floor.

For the position shown in solid lines in FIG. 1, there is an uncleaned area or poorly cleaned area on the surface 15 below the head 20, particularly at greater distances from the head. On the other hand, when the cleaning jet of water strikes the pool surface 15 too close to the head and at an angle to it, the area which is cleaned is considerably less than when an ideal perpendicular alignment of the pipe 12 with the surface 15 takes place.

It should also be noted that in the device of FIG. 1, when a misalignment as extreme as the one shown occurs, subsequent acceptable plastering of the pool bottom to cause the collar 18 to be flush with the plastered surface also is impaired. Obviously, the thickness of the plaster on the left-hand of the fitting assembly shown in FIG. 1 is much less than that required to reach the upper surface of the flange 18 on the right-hand side.

In order to avoid the necessity for jackhammering out of a portion of the concrete 14 and then applying heat to bend and straighten the PVC plastic pipe 12 to a perpendicular orientation with the surface 15 of the pool floor, the fitting collar shown in FIGS. 2 through 9 has been developed. The collar of FIGS. 2 through 9 includes the same basic interior configuration as the prior art collar 16. The collar of FIGS. 2 through 9, however, consists of three primary portions, namely a lower portion 38, an outwardly extending circular flange 32, and an upper extension 31 located above the flange 32.

As shown most clearly in FIGS. 4, 8 and 9, the outer surface of the lower portion 38 of the body of the mounting collar is in the form of a compound convex curve in planes including a central axis of the body. Immediately beneath the collar 32, the curve first extends outwardly relative to the central axis of the mounting collar and then inwardly back toward the central axis, as clearly shown in FIGS. 4, 8 and 9.

Spaced about the periphery of the lower portion 38 are a number of elongated, small ribs or projections which are oriented parallel to the central axis of the collar. FIG. 6 is an enlarged detail of one of these ribs; and it is to be noted that the ribs are designed to compensate for variations in the internal diameter of water supply pipes 12 in which the mounting collar may be installed. It has been found that sufficient variations occur that sometimes the collar may have a relatively loose fit; whereas at other times, the ribs 40 are crushed in the installation between the inner surface of the water supply pipe 12 and the outer surface of the body portion 38 of the collar.

The collar shown in FIGS. 2 through 9 is designed to be pushed snugly,after appropriate PVC cements have been applied to it and to the interior of the pipe 12, against the end of the pipe and the surface of the pool (15); so that the flange 32 rests on the surface 15 of the pool concrete, irrespective of the angular orientation of the pipe 12. This is illustrated in FIGS. 8 and 9. FIG. 8 shows a proper or perpendicular orientation of the pipe 12; whereas the pipe in FIG. 9 is at an angle similar to the one shown in the prior art installation of FIG. 1. By employing the compound curve on the portion 38, however, it is apparent from an examination of FIGS. 8 and 9 that the wide diameter, taken along a line parallel to the surface of the pool 15, functions to allow at least part of the body portion 38 of the collar to tightly engage the interior of the pipe 12 in which the collar is installed.

The different orientations of the collar for a perpendicular pipe 12, as shown in FIG. 8, and for an angled pipe, as shown in FIG. 9, clearly shows how the collar compensates for the angle of the pipe 12 to present a perpendicular axis to the surface 15 of the pool. Consequently, when the retaining collar fitting of FIGS. 2 through 9 is cemented into the end of the water supply pipe 12, it duplicates the angle of the stub up to the extent of the adjustment which is available from the compound curvature of the outside of the collar, and corrects it. Therefore, when the pop-up cleaning head 20 subsequently reciprocates in the collar, the supply of water from the head, over the surface 50 of the final plastering which takes place flush with the upper edge of the extension 31, effectively projects a stream of cleaning fluid parallel to the surface 50, as shown in FIG. 9; and the undesirable situation illustrated in the prior art device of FIG. 1 does not take place.

The interior of the collar fitting is provided with bayonet members 34 and 36 and a lower seat 42 of standard configuration for accommodating and installing a pop-up reciprocal cleaning head 20 in the collar. As shown in FIG. 8, the interior of the collar is a non-taped cylinder, as shown in the sections 30 and 44 in FIG. 8; so that a standard cleaning head of the type commonly used may be installed in this collar in the same manner as previously installed in the type of collar shown and described above in conjunction with FIG. 1. FIG. 9 shows, in solid lines, the position of the cleaning head 20 when it is in its extended or popped-up cleaning position; and the dotted line configuration illustrates the position of the bottom of the head when it is retracted, that is when no water under pressure is supplied through the pipe 12. When the head is retracted, the upper surface of the head 20 is flush with the upper edge of the flange 31, and therefore, with the plastered surface 50 of the pool; so that no projections in the pool bottom are present when the device is not being used to clean the pool.

The foregoing description of the preferred embodiment of the invention is to be considered as illustrative and not as limiting. Various other changes and modifications will occur to those skilled in the art for performing substantially the same function, in substantially the same way, to achieve substantially the same result without departing from the true scope of the invention as defined in the appended claims.

What is claimed is:

1. A mounting collar for the installation of water input nozzle in a swimming pool, the collar comprising:

a hollow main body portion having first and second end and having an outside wall designed to fit into the end of a wall supply pipe in a pool;

a flange extending outwardly from the periphery of the main body portion at the first end thereof to overlie the end of a water supply pipe; and the outside wall on the main body portion being curved to permit a predetermined amount of transverse tipping of the flange and of the main body portion within the water supply pipe at the time of installation of the collar.

2. The collar according to claim 1 wherein the first end of the main body portion is an upper end and the second end is a lower end with the lower end designed to fit within a water supply pipe, and wherein the flange extending outwardly from the periphery of the main body portion is located a predetermined distance below the upper end thereof.

3. The collar according to claim 2 wherein the main body portion is of a generally cylindrical configuration having a central axis, and wherein the outside wall on the main body portion which is designed to fit within a water supply pipe is in the form of a convex curve in planes including the central axis of the main body portion.

4. The collar according to claim 3 wherein the outside wall of the main body portion has a compound convex curvature beginning beneath the flange and extending outwardly from the flange and then back toward the central axis thereof to terminate at the second end thereof.

5. The collar according to claim 1 wherein the greatest external diameter of the main body portion, which fits into a water supply pipe, is selected to be substantially the same as the internal diameter of the water supply pipe.

6. A mounting collar for the installation of a water input nozzle in a swimming pool, the collar comprising:

a hollow main body portion having a central axis and circular cross sections perpendicular to such axis, with elongated ribs parallel to the central axis thereof located on the outside wall thereof, designed to fit into the end of a water supply pipe in a pool;

a flange extending outwardly from the periphery of the main body portion to overlie the end of a water supply pipe; and an outside wall on the main body portion which is curved to permit a predetermined amount of transverse tipping of the main body portion in the water supply pipe at the time of installation of the collar.

7. The collar according to claim 6 wherein the collar is made of a material designed such that the elongated ribs are deformable when the main body portion is pressed into the end of a water supply pipe.

8. The collar according to claim 7 wherein the greatest external diameter of the main body portion, which fits into a water supply pipe, is selected to be substantially the same as the internal diameter of the water supply pipe.

9. The collar according to claim 8 wherein the main body portion has an upper end and a lower end and the lower end is designed to fit into the end of a water supply pipe, and wherein the flange extending outwardly from the periphery of the main body portion is located a predetermined distance below the upper end thereof.

10. The collar according to claim 9 wherein the elongated ribs are dimensioned to cause a tight interference fit with a water supply pipe into which the lower end of the main body portion of the collar is inserted.

11. The collar according to claim 10 wherein the main body portion is of a generally cylindrical configuration with a first upper end and a second lower end and having a central axis, and wherein the outside wall on the main body portion is in the form of a convex curve in planes including the central axis of the main body portion.

12. The collar according to claim 11 wherein the outside wall of the main body portion has a compound convex curvature beginning beneath the flange and extending outwardly from the flange and then back toward the central axis thereof to terminate at the second end thereof.

13. The collar according to claim 12 wherein the collar is made of plastic material.

14. A mounting collar according to claim 13 further including members on the interior thereof for receiving a retractable cleaning head therein for movement between extended and retracted positions.

15. The collar according to claim 6 wherein the collar is made of plastic material.

16. The collar according to claim 15 wherein the elongated ribs are dimensioned to cause a tight interference fit with a water supply pipe into which the lower end of the main body portion of the collar is inserted.

17. The collar according to claim 16 wherein the collar is made of a material designed such that the elongated ribs are deformable when the main body portion is pressed into the end of a water supply pipe.

18. A mounting collar for the installation of a water input nozzle in a swimming pool, the collar comprising:

a hollow main body portion including members on the interior thereof for receiving a retractable cleaning head therein for movement between extended and retracted positions and designed to fit into the end of a water supply pipe in a pool;

a flange extending outwardly from the periphery of the main body portion to overlie the end of a water supply pipe; and an outside wall on the main body portion which is curved to permit a predetermined amount of transverse tipping of the main body portion in the water supply pipe at the time of installation of the collar.

19. A mounting collar for the installation of a water input nozzle in a swimming pool, the collar comprising:

a hollow main body portion of a generally cylindrical configuration, with an upper end and a lower end and having a central axis designed to fit into the end of a water supply pipe in a pool;

a flange extending outwardly from the periphery of the main body portion at the upper end thereof to overlie the end of a water supply pipe; and an outside wall on the main body portion which is in the form of a compound convex curve in planes including the central axis to permit a predetermined amount of transverse tipping of the main body portion in the water supply pipe at the time of installation of the collar, the compound convex curvature of the outside wall of the main body portion beginning beneath the flange and extending outwardly from the flange and then back toward the central axis to terminate at the lower end thereof.

* * * * *